United States Patent [19]

Panzini

[11] 4,174,594

[45] Nov. 20, 1979

[54] CLOSABLE SALES KIOSK

[75] Inventor: Michel A. Panzini, Senneville, Canada

[73] Assignee: Multi Restaurants Inc., Montreal, Canada

[21] Appl. No.: 898,461

[22] Filed: Apr. 20, 1978

[51] Int. Cl.[2] ..... E04B 1/346

[52] U.S. Cl. ..... 52/65; 52/66

[58] Field of Search ..... 52/64, 65, 66, 80, 236.2, 52/72, 79.4

[56] References Cited

U.S. PATENT DOCUMENTS

| | | | |
|---|---|---|---|
| 893,219 | 7/1908 | Altick | 52/64 X |
| 2,563,886 | 8/1951 | Taylor | 52/65 |
| 3,389,202 | 6/1968 | Waling | 52/80 UX |
| 3,545,454 | 12/1970 | Damin | 52/79.4 |
| 3,737,191 | 6/1973 | Fackre | 52/65 X |

FOREIGN PATENT DOCUMENTS

| | | | |
|---|---|---|---|
| 2300195 | 10/1976 | France | 52/79.4 |

*Primary Examiner*—Carl D. Friedman

[57] ABSTRACT

A simple molded plastic sales kiosk design is described having a unique closure means. The kiosk has a fixed substantially spherical shell member mounted on a cylindrical base. This fixed shell member is truncated by a vertical chordal plane in the region of the central axis, extending between the top of the shell and a horizontal serving counter mounted in an intermediate region of the shell. This serving counter is annular and extends between the vertical truncated edges of the shell. For entry into the kiosk, a gap is provided in the serving counter adjacent one of the vertical truncated edges. An outer shell including a spherical segment portion merging into a chordal skirt portion is mounted for rotation on and surrounding the fixed shell. This outer shell is truncated by a vertical chordal plane located forward of its central axis and is arranged to rotate relative to the fixed shell such that in the normal open position the serving counter is exposed and the entry gap is covered by the outer shell, in the normal closed position the serving counter and entry gap are entirely covered by the outer shell and in the entry position, the entry gap is uncovered.

6 Claims, 6 Drawing Figures

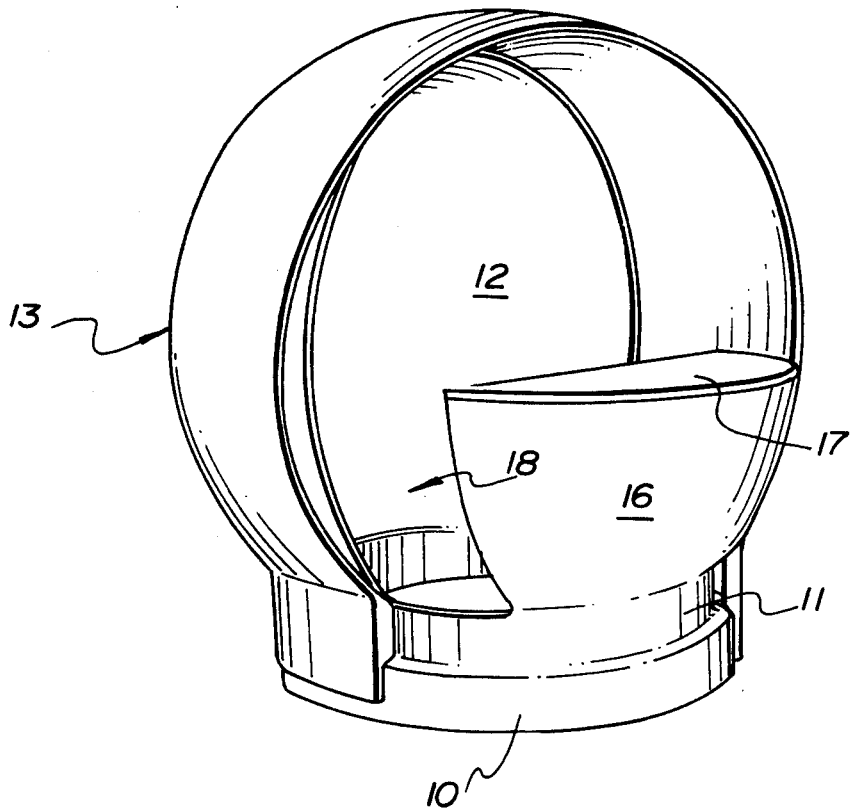

CLOSABLE SALES KIOSK

This invention relates to a sales kiosk and, more particularly, to a molded plastic sales kiosk having a unique closure system.

In the modern enclosed shopping malls, various small sales units are being used in the open and common areas of the mall. These small sales units may sell jewelry, snacks, orange juice, etc.

A problem with these small sales units has been to provide a design which will be visually very attractive while positioned in the open areas of the mall, while also being functionally useful in that they can be completely closed when not in use.

The present invention provides a unique solution to the above requirements.

Thus, the present invention relates to a sales kiosk comprising (a) a fixed substantially spherical shell member mounted on a cylindrical base, said shell member being truncated by a vertical chordal plane in the region of the center line thereof, said vertical chordal plane extending between the top of the shell and a horizontal serving counter in an intermediate region of the shell, said serving counter being annular and extending between the vertical truncated edges of the shell, and said serving counter including an entry way gap adjacent one of said vertical truncated edges and (b) an outer shell including a spherical segment portion merging into a chordal skirt portion mounted for rotation on and surrounding said fixed shell, with said chordal skirt portion adjacent said cylindrical base, said outer shell being truncated by a vertical chordal plane located forward of the center line thereof and being arranged to rotate relative to the fixed shell such that in the normal open position the serving counter is exposed and the entry gap is covered by the outer shell, in the normal closed position the serving counter and entry gap are entirely covered by the outer shell and in the entry position the entry gap is uncovered.

The outer shell can conveniently be supported on the fixed shell by means of a single pivot between the central vertical axis of the outer shell and the central vertical axis of the fixed shell. Also, to assist in the ease of rotating the outer shell, guide rollers or casters can be mounted between the outer shell skirt and the fixed shell cylindrical base.

The fixed shell can have an interior construction of wood and plastic laminates covered by a molded plastic shell. The outer shell is preferably entirely constructed from molded plastic and, in order to provide good weight:strength characteristics it is preferably formed with a urethane foam core covered by glass fiber.

The entire structure provides a design which is not only functionally very practical but also a design which is equally attractive whether the kiosk is open or closed.

Certain preferred embodiments of the invention are illustrated by the attached drawings in which.

Figure 2:
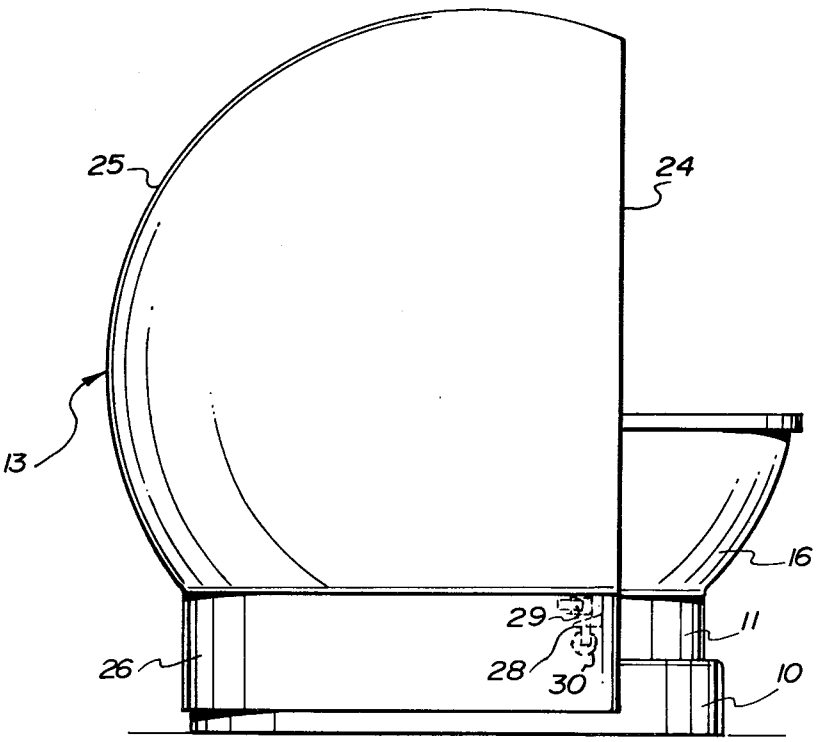
FIG. 2 is a side elevation of the kiosk in closed position.

As illustrated, the fixed portion includes a cylindrical base member 10 having crossed wooden support members 23 and an outer cylindrical rim of Fiberglass® reinforced plastic. The base 10 is covered by a circular floor 23*a*, which forms the floor of the kiosk. A second cylindrical shell 11 of lesser diameter than the base 10 rests on the floor 23 with an annular portion of the floor projecting beyond the shell 11 to form an annular ledge.

Mounted from the cylindrical shell 11 is the inner shell member 12 which is of a generally spherical shape having a truncated portion at the bottom merging into the cylindrical shell 11. The shell 12 has a rear partial spherical portion 14 which extends upwardly to a point just beyond its vertical central axis. It terminates at that point by vertical edges 15 which extend downwardly to a serving counter 17. A small spherical portion 16 continues down from the outer region of counter 17 to cylindrical member 11.

Figure 4:
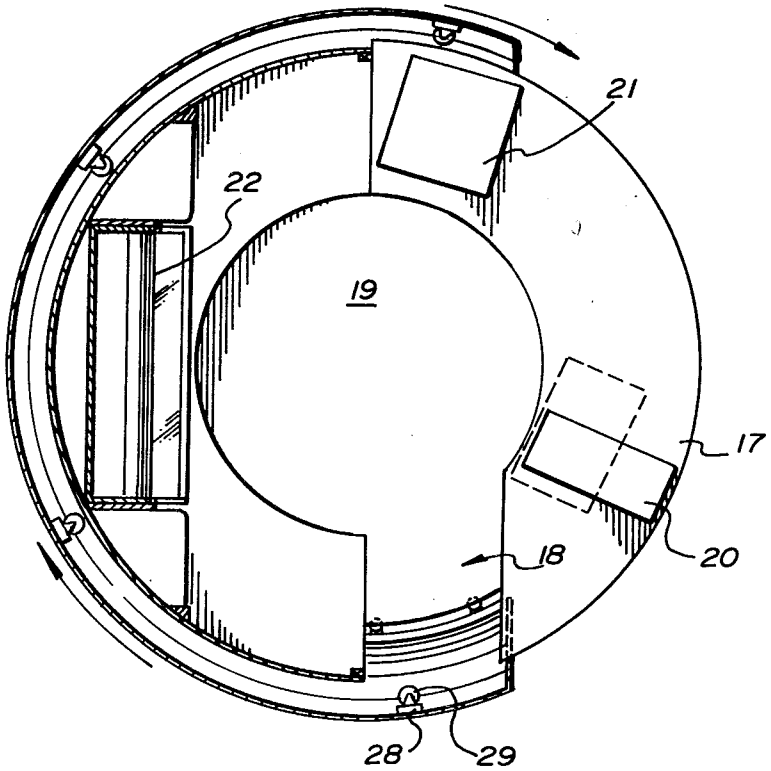
FIG. 4 is a horizontal section of the view shown in FIG. 1.

As will be seen from FIG. 4, the counter is annular in configuration and can be manufactured from a wood construction covered in a plastic laminate. A gap 18 is provided which serves as an entry way and this gap extends through the serving counter 17, down through the wall portion 16 and down through cylindrical portion 11. This entry way 18 provides easy access to the work area 19.

The serving counter 17 can be organized in any desirable manner with the particular arrangement shown in FIG. 4 being intended for serving fresh orange juice. Thus, there is shown an orange squeezing machine 20, a cash register 21 and an orange rack 22. Of course, any variety of snacks, drinks or small merchandise, such as jewelry, etc. can be sold from this kiosk.

The outer or closure shell 13 is a simple molded plastic shell and is preferably formed with a urethane foam core encased in layers of Fiberglass® reinforced plastic. This provides a strong, rigid, yet light-weight construction. The shell 13 includes a spherical portion 25 which merges at a lower region into a cylindrical skirt portion 26. This skirt portion 26 is adjacent the cylindrical base portions 10 and 11.

The shell 13 is supported in position by means of a pivot 27 which supports the central point of shell 13 directly above the central point of shell 12. Thus, the shell 13 is entirely supported from the one pivot point 27 providing extremely easy rotation. To further assist this ease of rotation, several casters 28 may be positioned between the inner face of skirt 26 and the outer face of cylindrical base portion 11.

Figure 6:
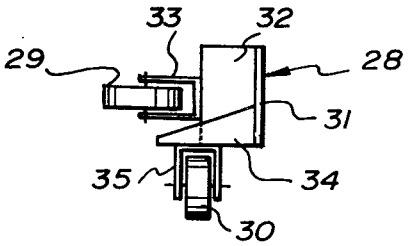
FIG. 6 is a side elevation of a guide wheel assembly.
Figure 5:
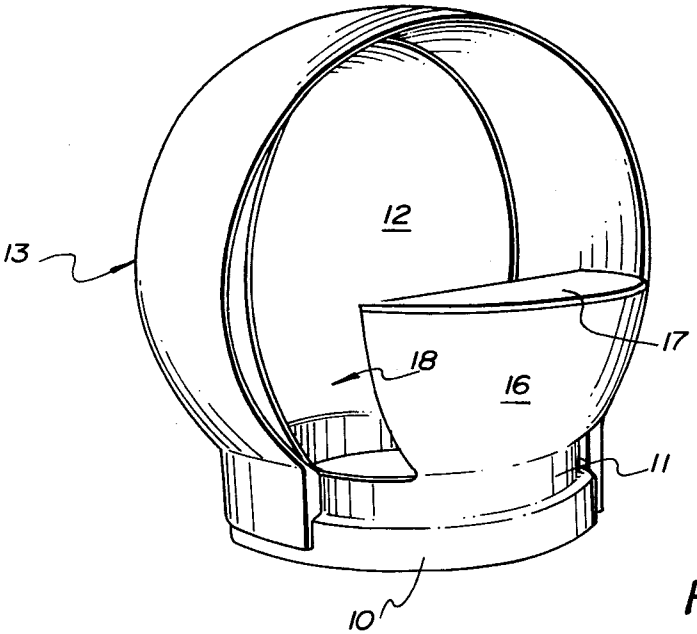
FIG. 5 is a perspective view of the kiosk in the entry position.

The castor assemblies 28 include a horizontally rotatable wheel 29 which engages cylindrical shell 11 and a vertically rotatable wheel 30 which engages the projecting annular ledge of floor 23*a*. As shown in greater detail in FIG. 6, each pair of wheels is mounted on a support bracket, including a plate member 31 connected to skirt 26, projecting plates 32 supporting a U-shaped wheel supporting member 33 and projecting plates 34 supporting a U-shaped wheel supporting member 34.

Figure 1:
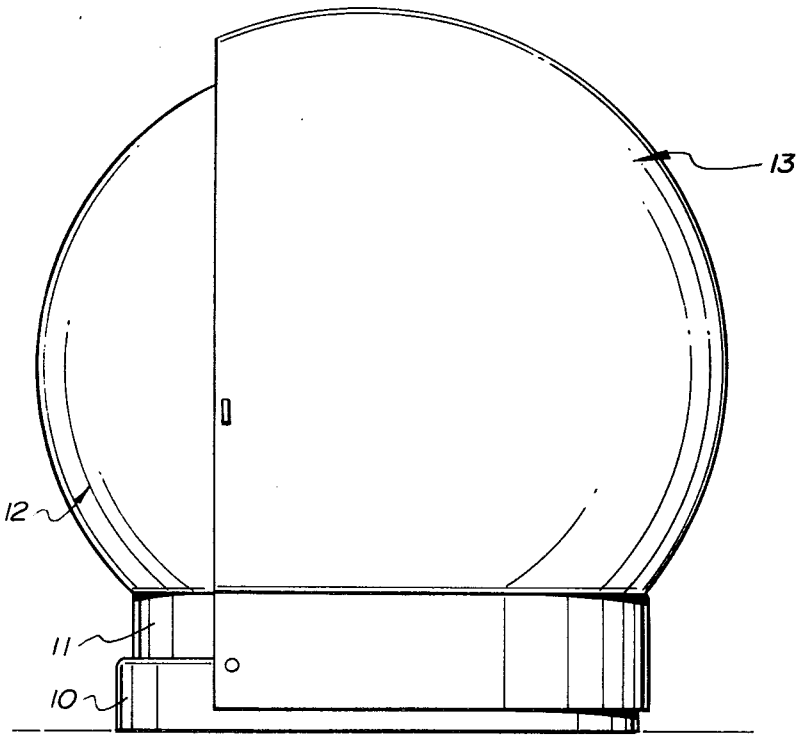
FIG. 1 is a side elevation of the kiosk in open position.
Figure 3:
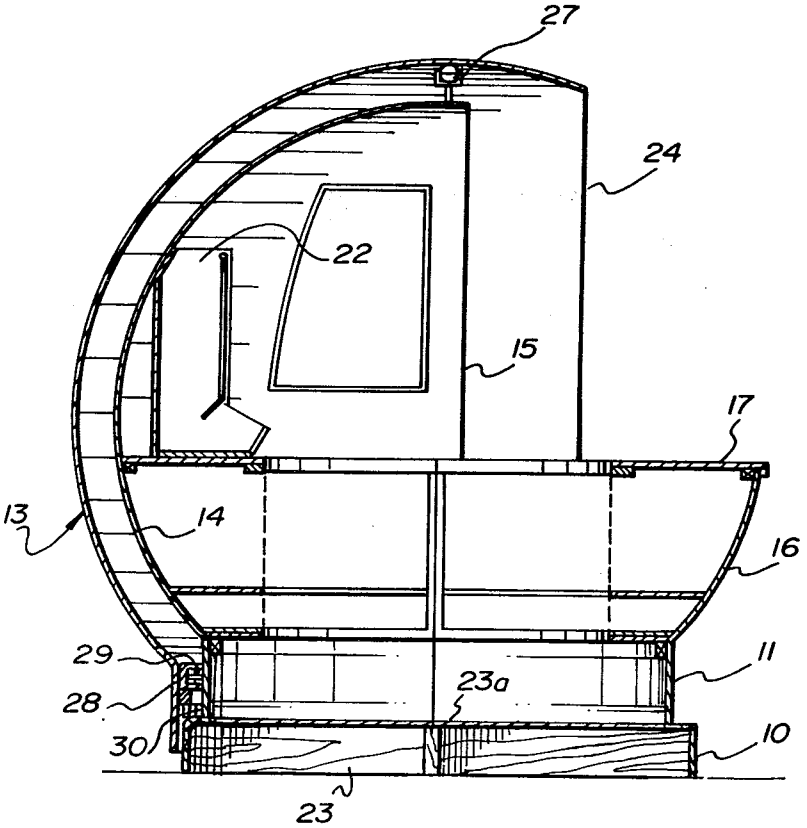
FIG. 3 is a vertical section of the view shown in FIG. 1.

As will be evident from the drawings, the outer shell 13 includes a main spherical portion 25 which extends beyond the central axis thereof and terminates in a vertical edge 24. The purpose of this particular design will be evident from FIGS. 1, 3 and 4. Thus, in the normal open or operating position, the front edge 24 of shell 13 extends just forward of the entryway 18 so that it completely encloses the entryway while leaving the main serving counter 17 open to the public. When the kiosk is to be closed either for a night or weekend or even for only a few minutes, the outer shell 13 is simply rotated around to the position shown in FIG. 2 so that the serving counter 17 and the entryway 18 are entirely closed. In this position the outer shell 13 may be locked with a key so that any access to the interior is prevented other than by destruction of the shell.

The outer shell 13 also serves the third function of providing a closable door to the entryway 18. Moreover, the entryway 18 can be maintained in an open or closed position at the choice of the kiosk attendant and it will be evident from FIG. 4 that the entryway 18 can be maintained in an open position by rotating the outer shell slightly in a clockwise position while still leaving the majority of the serving counter open to the public.

Thus, it will be seen that the structural configuration according to this invention provides a unique combination of an inner construction with a rotatable outer shell which is entirely functional in terms of being able to completely close the kiosk to the public while providing a most attractive visual design in either open or closed position.

The embodiments of the invention in which an exclusive property or privilege is claimed are defined as follows:

1. A sales kiosk comprising (a) a fixed substantially spherical shell member mounted on a cylindrical base, said shell member being truncated by a vertical chordal plane in the region of the center line thereof, said vertical chordal plane extending between the top of the shell and a horizontal serving counter in an intermediate region of the shell, said serving counter being annular and extending between the vertical truncated edges of the shell, and said serving counter including an entryway gap adjacent one of said vertical truncated edges and (b) an outer shell including a spherical segment portion merging into a chordal skirt portion mounted for rotation on and surrounding said fixed shell, with said chordal skirt portion adjacent said cylindrical base, said outer shell being truncated by a vertical chordal plane located forward of the center line thereof and being arranged to rotate relative to the fixed shelf such that in the normal open position the serving counter is exposed and the entry gap is covered by the outer shell, in the normal closed position the serving counter and entry gap are entirely covered by the outer shell and in the entry position the entry gap is uncovered.

2. A kiosk according to claim 1 wherein the outer shell is supported on the fixed shell by means of a pivot between the central vertical axis of the outer shell and the central vertical axis of the fixed shell.

3. A kiosk according to claim 1 wherein guide rollers are mounted between the outer shell skirt and the fixed shell cylindrical base.

4. A kiosk according to claim 1 or 2 wherein the shells are moulded plastic.

5. A kiosk according to claim 1, 2 or 3 wherein the shells are moulded, glass fiber reinforced plastic.

6. A kiosk according to claim 1, 2 or 3, wherein the shells comprise a urethane foam core covered by glass fiber reinforced plastic.

* * * * *